US007209085B2

(12) United States Patent
Rowell et al.

(10) Patent No.: US 7,209,085 B2
(45) Date of Patent: Apr. 24, 2007

(54) MECHANO-ELECTRONIC ANTENNA

(75) Inventors: Corbett Ray Rowell, Mongkok (HK); William H. Darden, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 7 days.

(21) Appl. No.: 11/190,103

(22) Filed: Jul. 25, 2005

(65) Prior Publication Data

US 2006/0066489 A1 Mar. 30, 2006

(30) Foreign Application Priority Data

Jul. 23, 2004 (CN) ..... 2004 1 0070842

(51) Int. Cl.
*H01Q 1/24* (2006.01)

(52) U.S. Cl. ..... 343/702; 343/700 MS

(58) Field of Classification Search ..... 343/700 MS, 343/702

See application file for complete search history.

(56) References Cited

U.S. PATENT DOCUMENTS 6,061,025 A * 5/2000 Jackson et al. ..... 343/700 MS
7,046,202 B2 * 5/2006 Chiang et al. ..... 343/700 MS

* cited by examiner

*Primary Examiner*—Tan Ho
(74) *Attorney, Agent, or Firm*—Robert J. Zeitler

(57) ABSTRACT

A mechano-electronic antenna includes an insulating base board having a first face and a second face which are opposite to each other, and a first radiating surface formed on the first face; and a rotating shaft, which is rotationally provided on and gets through the insulating base board, and is near the first radiating surface, and at least one metal branch arm extends outwards from the rotating shaft on the first face of the insulating base board so that the metal branch arm can be electrically connected with the first radiating surface when the rotating shaft is rotated relative to the insulating base board from the first position to the second position. By these means, the geometrical shapes of the antenna are changed to improve the radiating efficiency of the antenna.

9 Claims, 4 Drawing Sheets

MECHANO-ELECTRONIC ANTENNA

FIELD OF THE INVENTION

The present invention relates to a mechano-electronic antenna, more particularly, to a mechano-electronic antenna wherein the mechanical assembly is driven by the electric power and by this means the geometric shape of the antenna is changed, then the operating wave band of the antenna is changed and the radiating effect of the antenna is improved.

BACKGROUND OF THE INVENTION

Along with the miniaturization of the mobile telephones and the parts thereof, and along with the more functions integrated in a single mobile telephone, the requirement for the mini multiband antenna increases steadily. Yet, when the size of the antenna is shrinkled the bandwidth and/or the radiating effect thereof is reduced because of the Wheeler's Theorem of the electromagnetic wave. Particularly, when the size of the antenna is shrinkled more and more, the bandwidth (or the ability of the antenna to cover multiband) thereof is reduced sharply.

Therefore, some methods to resolve the above problems are projected. One of them is that a radio device (a mobile telephone) is integrated in the antenna so that the whole radio device is used as an antenna, thus, it doesn't have to shrinkle the size of the antenna. Yet, there are two shortcomings in the method. Firstly, the SAR values (Specific Absorption Ratio, which represents the measured value of the electromagnetic radiation absorbed by people) increases because the mobile telephone is close with the head in use. Secondly, the antenna come into being detuning easily when a user takes hold of the mobile telephone so as to influence sharply the ability to receive and send signals because the current is distributed all over the whole mobile telephone by the antenna.

The other method is to use a so-called 'smart' or 'active' antenna. The difference between the smart/active antenna and the passive antenna in a steady/single state (namely no mobile part) is that the smart/active antenna uses a matching circuit, a switch and other devices so as to be operated in several states in one of which the antenna is always a narrow band high efficiency antenna. So, the antenna system comes into being a wide band high efficiency antenna when the antenna can be operated in several states.

Furthermore, the present smart/active antenna is always equipped with one or several matching circuits or grounding surfaces. The antenna uses an electronic switch to carry out a switching action so as to control the connection between the antenna and the matching circuits or grounding surfaces, and further to change the operating state of the antenna. And the typical switches include a diode, a gallium-arsenide switch, a micro mechano-electronic switch, a transistor, a balance-unbalance converter and so on. Yet, the above switches are needed to be grounded and the grounding point is very near the antenna to result in effecting the ability to receive and send the signals of the antenna sharply. Moreover, the electronic characters of the electric switches limit the efficiency of the antenna.

SUMMARY OF THE INVENTION

Accordingly, an object of the present invention is to provide a mechano-electronic antenna, which use the electric power to control the absolute mechanical assembly so as to change the geometric shape of the antenna, and can work in several different bands.

According to the above-mentioned object, the present invention provides a mechano-electronic antenna including an insulating base board and a rotating shaft. The insulating base board has a first face and a second face which are opposite to each other and a first radiating surface on which there is a feed-in point is formed on the first face. The rotating shaft is rotationally provided on and gets through the insulating base board. The rotating shaft is near the first radiating surface and extends outward to form at least one metal branch arm on the first face of the insulating base board so that the metal branch arm can be electrically connected with the first radiating surface when the rotating shaft is rotated relative to the insulating base board from a first position to a second position. And by this means the geometric shape of the antenna and the efficiency of the antenna are changed.

DETAILED DESCRIPTION OF THE INVENTION

In the following detailed description about the three preferable embodiments with reference to the accompanying drawings, it provides a thorough understanding of the foregoing and other technical contents, features and functions of the present invention.

Before the invention is described in detail, it should be noted that the same reference number symbols represent the same component parts.

Figure 1:
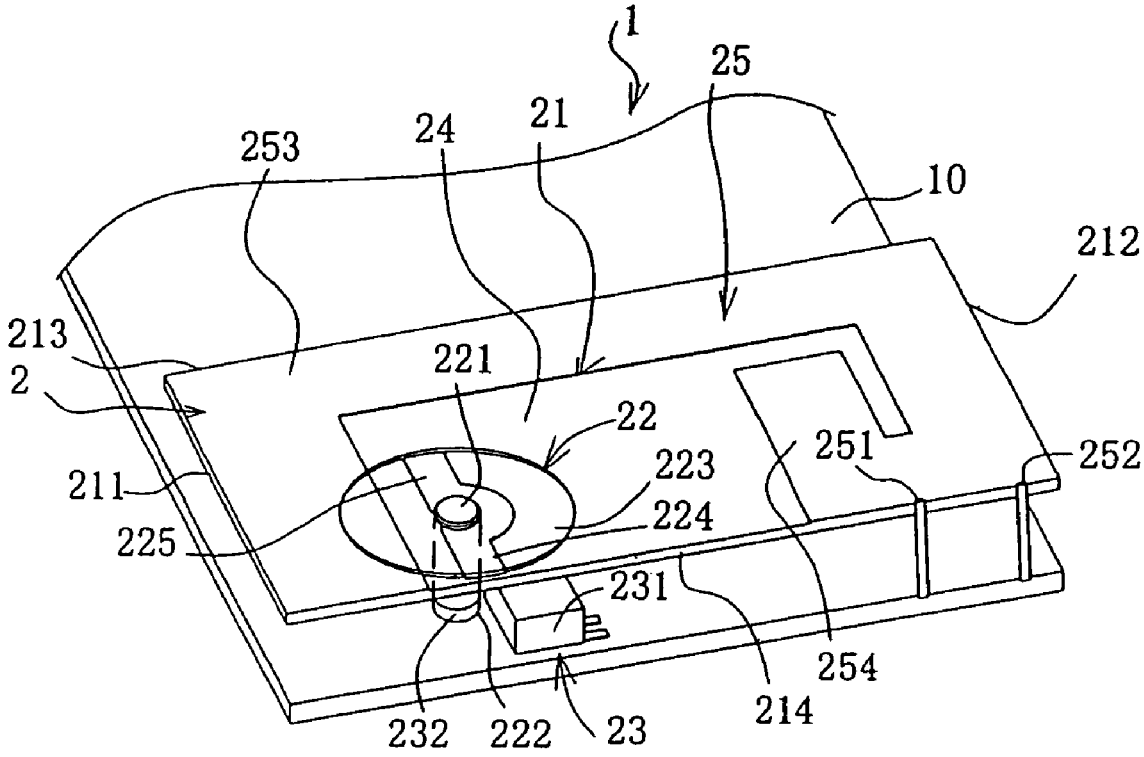
FIG. 1 is a schematic illustration of the shape and structure of the mechano-electronic antenna according to the first preferable embodiment of the present invention which shows that the insulating rotating shaft is on the first position.

As shown in FIG. 1, it shows the first preferable embodiment of the mechano-electronic antenna which can be used in the mobile telephones using the built-in antennas and the radio communication devices.

The mechano-electronic antenna 2 is amounted on a circuit board 1 (refer to the circuit boards of the mobile telephones or the radio communication devices) having a grounding surface 10, which includes an insulating base board 21, a rotating shaft 22 and a mechanical switch 23.

The insulating base board 21 is a long-shaped board which has a first short side 211 and a second short side 212 which are opposite to each other and has a first long side 213 and a second long side 214 which are opposite to each other.

The insulating base board 21 and the circuit board 1 are spaced and stacked one upon the other, and the insulating base board 21 has a first face 24 opposite to the grounding surface 10 and a second face (not shown in the figure) facing the grounding surface 10. A first radiating surface 25 is formed on the first face 24, which includes a feed-in point 251 and a grounding point 252. The feed-in point 251 is provided on the second long side 214 which is close to the second short side 212 on the circuit board 1 in order to be electrically connected to the circuit board 1 to feed in the signals. The grounding point 252 is posited close to the second short side 21 and near the feed-in point 251. The grounding point 252 is a selectively grounding point which can be selected to be connected to the grounding surface 10 to make the antenna be a PIFA antenna or to be unconnected to make the antenna be a patch antenna.

The first radiating surface 25 includes a first radiating segment 253 and a second radiating segment 254. The first radiating segment 253 extends along the second long side 214 from the feed-in point 251 to an end of the second long side 214 connected to the second short side 212, then it extends along the second short side 212 to an end of the second side 212 connected to the first long side 213, then it extends along the first long side 213 to an end of the first long side 213 connected to the first short side 211, then it extends along the first short side 211 to an end of the first short side 211 connected to the second long side 214. And the second radiating segment 254 extends a distance along the second long side 214 from the feed-in point 251, and then it is bent with 90 degree towards the first long side 213 and extends to be close to the position near the first radiating segment 253. So the second radiating segment 254 is shorter than the first segment 253 very much, from which we can conclude that the second radiating segment 254 works in the high frequency band (such as 1900 MHz in this embodiment) and the first radiating segment 253 works in the low frequency band (such as 900 MHz in this embodiment).

The rotating shaft 22 may be an insulator or a metal part having a first end 221 and a second end 222 which are opposite to each other, which can be horizontally rotationally provided on and gets through the insulating base board 21. There are a first metal branch arm 224 and a second metal branch arm 225 extending outwards on the first end 221. An (transparent) insulating plate body 223 (herein plate body 223 for short) is provided on the first end 221 of the rotating shaft 22 (or integrated with it) in order to support the first and the second metal branch arms 224, 225 better. The first and the second metal branch arms 224, 225 are attached to the face of the plate body 223 facing the second end 222 of the rotating shaft 22 with the shape of a metal sheet so as to be electrically connected at the axes of the rotating shaft 22 and extend outward from the axes of the rotating shaft 22 to the edge of the plate body, respectively, then they are connected to align.

A through hole (not shown in the figure) is provided in the tail-end of the first radiating segment 253 of the first radiating surface 25 on the insulating base board 21 in order to fix the rotating shaft 22 on the insulating base board 21. So the rotating shaft 22 may get through the through hole with the second end 222 downward. The rotating shaft 22 is rotated relative to the insulating base board 21 and is located on the circuit board 1. The plate body 223 on the first end 221 can be flatly attached to the first face 24 of the insulating base board 21 and overlap with the tail-end portion of the first radiating segment 253.

Figure 2:
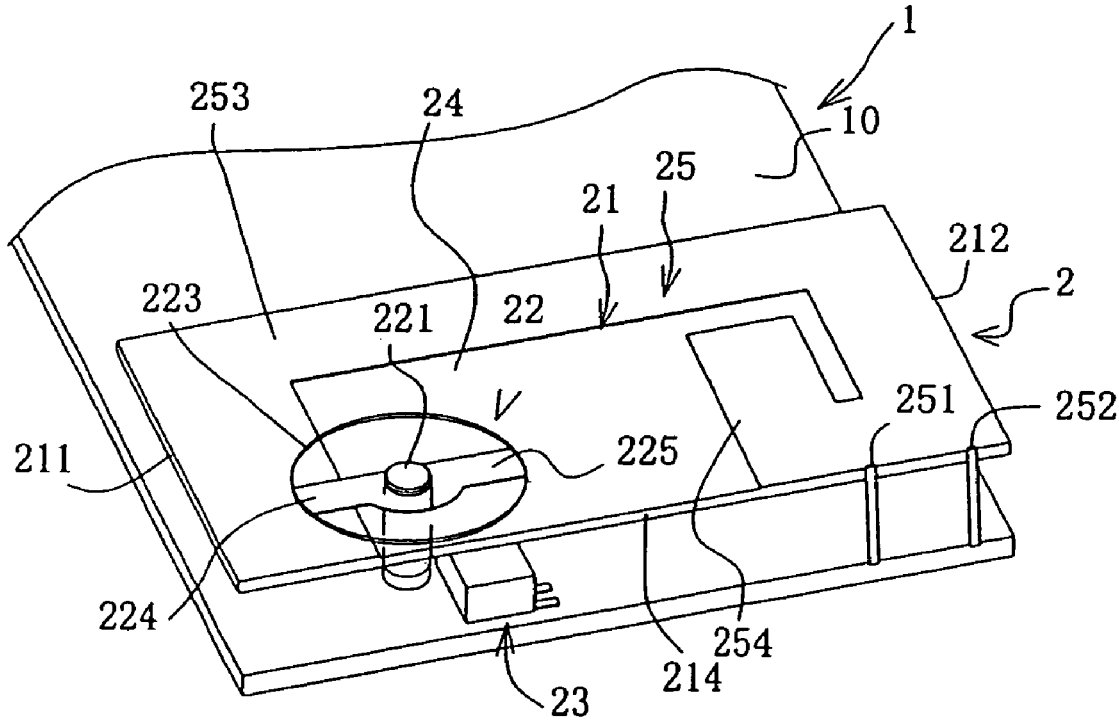
FIG. 2 is a schematic illustration of the using state according to the first embodiment wherein the insulating rotating shaft is on the second position.

Thereby, as shown in FIG. 1, when the force is applied to the rotating shaft 22 and the rotating shaft 22 brings along the plate body 223 to be rotated relative to the insulating base board 21 from the first position where the first and the second metal branch arms 224, 225 are electrically unconnected with the first radiating segment 253 to the second position as shown in FIG. 2, the first metal branch arm 224 is electrically connected with the tail-end of the first radiating segment 253 so that the radiating length of the first radiating segment 253 effectively extends by the first and the second metal branch arms 224, 225, so the working band thereof offsets and the antenna can work in the low frequency band. Moreover, the so-called "second position" here represents any position where any one of the first and the second branch arms 224, 225 is moved to be electrically connected with the tail-end of the first radiating segment 253.

Therefore, in the actual uses of the radio communication products the rotating shaft 22 is rightly driven to change the geometric shape of the antenna. And in this embodiment the mechanical switch 23 has the function of driving the rotating shaft 22.

The mechanical switch 23 includes a solenoid 231 and a magnetic element 232. The magnetic element 232 is a magnet fixed on the second end 222 of the rotating shaft 22. The solenoid 231 is a known electromagnetic element posited on the circuit board 1 near to the second end 222 of the rotating shaft 22, which is mainly constituted of a tube, a copper winding coiling the outer surface of the tube and an iron core getting through the inside of the tube. One end of the tube is opposite to the magnetic element 232 posited on the second end 222 of the rotating shaft 22. And the copper winding of the solenoid 231 is electrically connected to the power supply of the circuit board 10. When the copper winding is supplied with the current, the magnetic field whose polarity is opposite to the magnetic element 232 is produced inside the tube, which can drive the magnetic element 232 to bring along the rotating shaft 22 to rotate. So the magnetic element 232 is driven to bring along the rotating shaft 22 to rotate from the first position to the second position by supplying the proper current/power supply to the solenoid 231 in order to realize the object of the foregoing rightly changing the geometric shape of the antenna.

Figure 3:
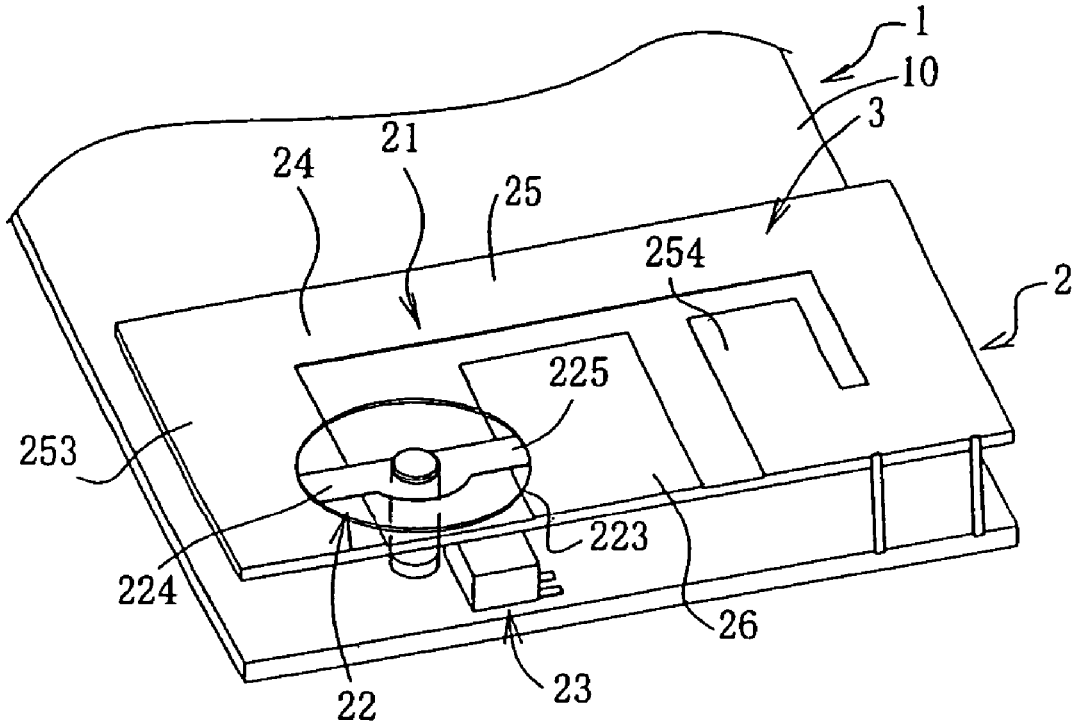
FIG. 3 is a schematic illustration of the using state of the mechano-electronic antenna according to the second preferable embodiment of the present invention which shows that the insulating rotating shaft is on the second position.

And as shown in FIG. 3, it shows the second preferable embodiment of the mechano-electronic antenna according to the present invention, which is different from the first embodiment. The mechano-electronic antenna 3 according to the embodiment includes a rectangular second radiating surface 26 posited on the first face 24 of the circuit board 21 besides the all components of the first embodiment. The second radiating surface 26 is located between the rotating shaft 22 and the second radiating segment 254 of the first radiating surface 25 and overlap partly with the plate body 223 posited on the first end 221 of the rotating shaft 22.

So, when the rotating shaft 22 is rotated to the second position as shown in FIG. 3, the first and the second metal branch arms 224, 225 are electrically connected to the first and the second radiating surfaces 25, 26, respectively, which makes the geometrical shape of the first radiating surface 25 (especially the first radiating segment 253) changed and further makes the working band (namely the low frequency band) of the first radiating segment 253 offset so as to improve the voltage stationary-wave ratio and the gain value thereof.

Figure 4:
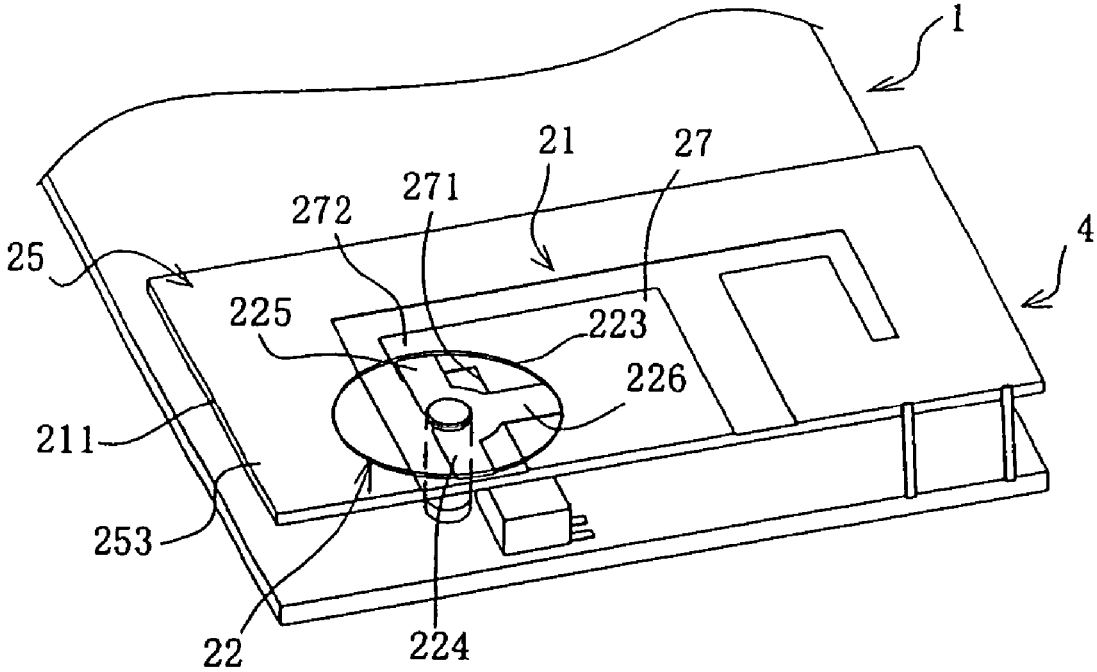
FIG. 4 is a schematic illustration of the shape and structure of the mechano-electronic antenna according to the third preferable embodiment of the present invention which shows that the insulating rotating shaft is on the first position.
Figure 5:
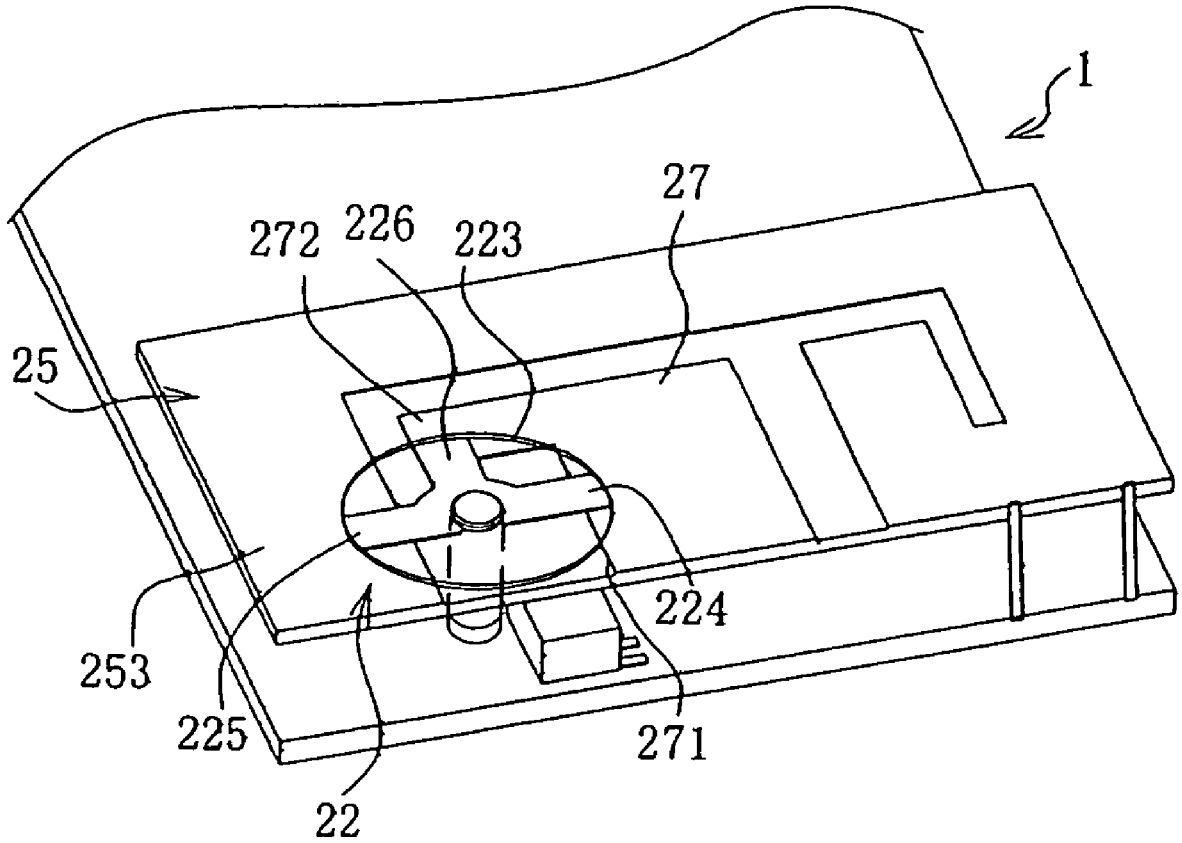
FIG. 5 is a schematic illustration of the using state according to the first embodiment wherein the insulating rotating shaft is on the second position.

Moreover, as shown in FIG. 4, it shows the third preferable embodiment of the mechano-electronic antenna according to the present invention, which is different from the second embodiment. The second radiating surface 27 of the mechano-electronic antenna 4 of the embodiment is provided with a side 271 near the first short side 211 of the circuit board 21 and further extends outward from one end of the side 271 toward the first short side 211 to form a contacting section 272. And besides that there are the first and the second metal branch arm 224, 225 on the plate body 223 of the rotating shaft 22, a third metal branch arm 226 is attached to the plate body 223 of the rotating shaft 22. The third metal branch arm 226 extends outwards from the center of the plate body 223 to the edge of the plate body 223 and is electrically connected to the first and the second metal branch arms 224, 225 with the connection angle being 90 degree. So, when the rotating shaft 22 is rotated from the first position as shown in FIG. 4 where any of the first, the second and the third metal branch arms 224, 225 and 226 isn't electrically connected to the first radiating surface 25 to the second position as shown in FIG. 5, the second metal branch arm 225 is electrically connected to the first radiating segment 253 of the first radiating surface 25, and the first and the third metal branch arms 224, 226 are electrically connected to the side 271 and the contacting segment 272 of the second radiating surface 27, respectively. By these means, besides that the geometrical shape of the antenna is changed and further the value of the voltage stationary-wave ratio and the gain value thereof are improved, the inductance value of the antenna is decreased and further the radiating efficiency is improved.

Figure 6:
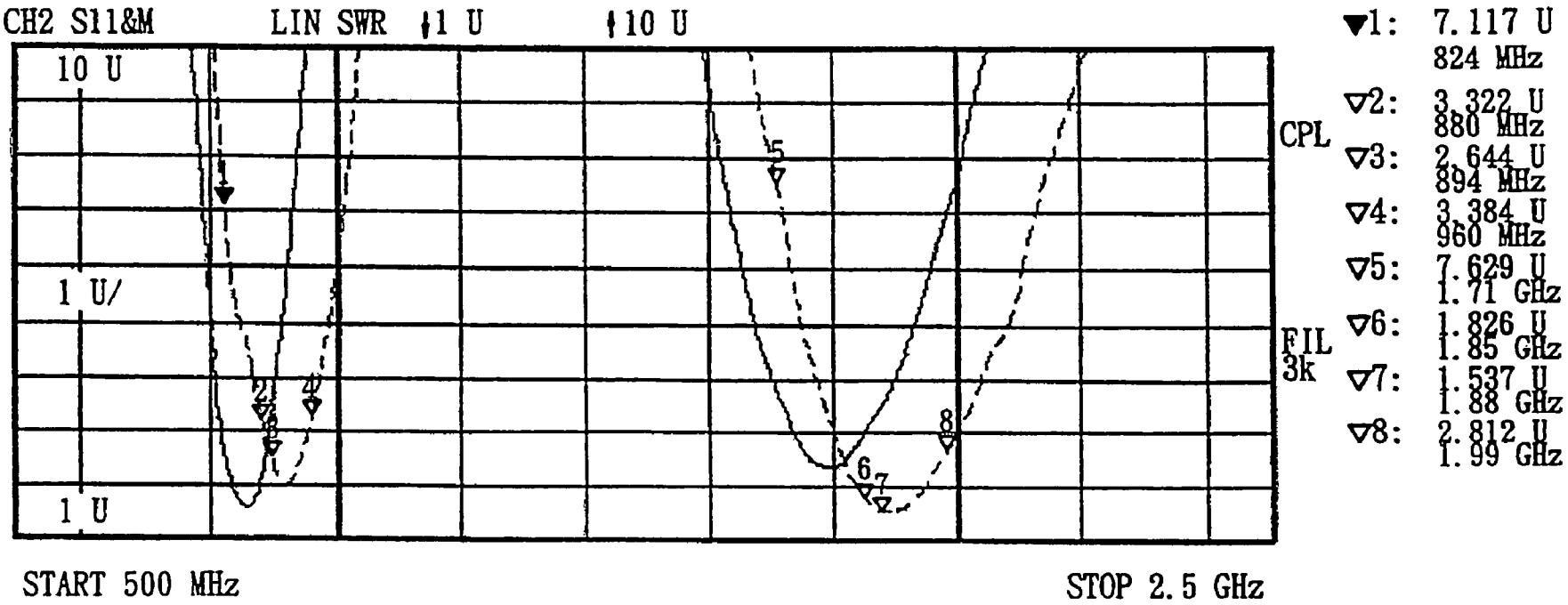
FIG. 6 is a graph showing the measured data of the voltage stationary-wave ratio according to the third embodiment.

As shown in FIG. 6, it shows the practical measured value of the voltage stationary-wave ratio of the mechano-electronic antenna 4 according to the third embodiment, and it shows the state in which the high and the low bands of the mechano-electronic antenna 4 offset when the rotating shaft 22 is rotated from the first position as shown in FIG. 4 to the second position as shown in FIG. 5, and it especially shows the state in which the voltage stationary-wave rate of the low band section is dropped from 2 to the value below 2 when the rotating shaft 22 is rotated from the first position to the second position.

Furthermore, besides the connection state as shown in FIG. 5, when the rotating shaft 22 is rotated to the position where the second and the third metal branch arms 225, 226 are electrically connected to the contacting segment 272 of the second radiating surface 27 and the first radiating segment 253 of the first radiating surface 25, respectively, the mechano-electronic antenna 4 has a geometrical shape similar to the second embodiment and is operated in another band similar to the second embodiment. So with the rotation of the rotating shaft 22, the first, the second and the third metal branch arms 224, 225 and 226 are electrically connected to the first and the second radiating surfaces 25, 26, respectively and in turn. By this means, the geometrical shapes of the antenna 4 are changed differently to change the values of the voltage stationary-wave ratio, the gain and the inductance thereof in order to improve the radiating efficiency of the antenna.

It can be seen from the above description, when the insulating base board 21 is only provided with the first radiating surface 25, when the rotating shaft 22 is rotated from the first position to the second position, one of the first and the second metal branch arms 224, 225 can be electrically connected to the first radiating segment 253 of the first radiating surface 25 to increase the length of the first radiating segment so that the antenna can work in low band by the means of providing the first and the second metal branch arms 224, 225 on the rotating shaft 22. When the second radiating surface 26 is also posited on the insulating base board 21, when the rotating shaft 22 is rotated to the second position to be electrically connected to the first and the second radiating surfaces 25, 26 to change the geometrical shapes of the antenna and improve the value of the voltage stationary-wave ratio and the gain value. Furthermore, when the third metal branch arm 226 is further posited on the rotating shaft 22, the rotating shaft 22 is rotated to the second position to make the second and the third metal branch arms 225 and 226 electrically connected to the different positions of the second radiating surface 26 to decrease the inductance value of the antenna and further improve the radiating efficiency of the antenna.

Moreover, the mechanical switch 23 is a single mechanical switch driven by the electrical power and has some advantages such as the perfect working band, the perfect electric insulation, the low loss and so on compared to the present electric switches.

Of course the present isn't limited to the embodiment as disclosed above, that is, more than three metal branch arms with one end electrically connected to each other are posited on the plate 223 of the rotating shaft 22, and more than two radiating surfaces are formed on the insulating base board 21, so, when the rotating shaft 22 is rotated to an appropriate position to be electrically connected to the radiating surfaces and so on by the metal branch arms to fulfill the objects such as changing the value of the voltage stationary-wave ratio and the gain value/or the inductance value of the antenna and so on.

The above description is only the preferred embodiment of the present invention, without limiting the range of the present invention, and each simple equivalent modifications and variations made from the claimed range of the application and the described content of the invention will are included within the protecting scope of the present invention.

What is claimed is:

1. A mechano-electronic antenna, which includes:

an insulating base board, which has a first face and a second face which are opposite to each other, and a first radiating surface formed on the first face, and a feed-in point formed on the first radiating surface;

a rotating shaft, which is rotationally provided on and gets through the insulating base board, and is near the first radiating surface, and extends outwards to form at least one metal branch arm on the first face of the insulating base board so that the metal branch arm can be electrically connected with the first radiating surface when the rotating shaft is rotated relative to the insulating base board from a first position to a second position.

2. A mechano-electronic antenna as claimed in claim 1, wherein the first position is any position where the metal branch arm is electrically unconnected with the first radiating surface, and the second position is any position where the metal branch arm is electrically connected with the first radiating surface.

3. A mechano-electronic antenna as claimed in claim 2, wherein a third metal branch arm further extends outwards from the rotating shaft and is electrically connected to the first and the second metal branch arms, the second and the third metal branch arms are electrically connected to the different positions of the second radiating surface when the rotating shaft is rotated from the first position to the second position relative to the insulating base board.

4. A mechano-electronic antenna as claimed in claim 1, wherein a second radiating surface is further formed on the first face of the insulating base board and is separate from the first radiating surface and is near the rotating shaft, and a first and a second metal branch arms extending outwards from the rotating shaft are posited on the first face of the insulating base board and are electrically connected to each other, and the first and the second metal branch arms are electrically connected to the first radiating surface and the second radiating surface, respectively, when the rotating shaft is rotated from the first position to the second position relative to the insulating base board.

5. A mechano-electronic antenna as claimed in claim 1, wherein the rotating shaft is controlled by an electric signal and is rotated from the first position to the second position relative to the insulating base board.

6. A mechano-electronic antenna as claimed in claim 1, wherein the rotating shaft has a first end and a second end which are opposite to each other, and an insulating plate body is posited on the first end, and the metal branch arms with a shape of a metal sheet are attached to the face of the plate body facing the second end of the rotating shaft, and the second end of the rotating shaft gets through the insulating base board with the direction from the first face to the second face of the insulating base board so as to make the plate body located at the first end near the first face of the insulating base board.

7. A mechano-electronic antenna as claimed in claim 6, wherein the mechano-electronic antenna is posited on a circuit board having a grounding surface, and the insulating base board and the circuit board are spaced and stacked one upon the other, and the second surface of the insulating base board is facing the grounding surface of the circuit board, and the feed-in point is electrically connected to the circuit board.

8. A mechano-electronic antenna as claimed in claim 7, wherein the antenna further includes a mechanical switch, which includes a solenoid and a magnetic element controlled by the solenoid, and the magnetic element is fixed on the second end of the rotating shaft, and the solenoid is posited on the grounding surface of the circuit board, and one end of the solenoid is opposite to the magnetic element, and the solenoid can receive the electric signals from the circuit board and be controlled by the signals to drive the magnetic element to bring along the rotating shaft to rotate from the first position to the second position.

9. A mechano-electronic antenna as claimed in claim 7, wherein a grounding point is posited on the first radiating surface and can be selectively electrically connected to the grounding surface of the circuit board.

* * * * *